US007757781B2

(12) United States Patent
Hay et al.

(10) Patent No.: US 7,757,781 B2
(45) Date of Patent: Jul. 20, 2010

(54) DOWNHOLE MOTOR ASSEMBLY AND METHOD FOR TORQUE REGULATION

(75) Inventors: Richard T. Hay, Spring, TX (US); Victor Gawski, Whitecairns (GB)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 11/871,801

(22) Filed: Oct. 12, 2007

(65) Prior Publication Data

US 2009/0095528 A1 Apr. 16, 2009

(51) Int. Cl.
*E21B 44/00* (2006.01)

(52) U.S. Cl. ..... 175/26; 175/107

(58) Field of Classification Search ..... 175/107, 175/92, 109; 415/903
See application file for complete search history.

(56) References Cited

U.S. PATENT DOCUMENTS

| | | | | |
|---|---|---|---|---|
| 3,840,080 | A | 10/1974 | Berryman | |
| 4,254,836 | A | 3/1981 | Russell | |
| 4,606,415 | A | 8/1986 | Gray, Jr. et al. | |
| 4,630,691 | A | 12/1986 | Hooper | |
| 5,171,139 | A * | 12/1992 | Underwood et al. | 418/48 |
| 5,404,904 | A | 4/1995 | Glaser | |
| 5,606,415 | A | 2/1997 | Doty | |
| 5,620,056 | A | 4/1997 | Eppink | |
| 6,173,771 | B1 | 1/2001 | Eslinger et al. | |
| 6,293,358 | B1 | 9/2001 | Jager | |
| 6,497,556 | B2 | 12/2002 | Zupanick et al. | |
| 6,588,518 | B2 | 7/2003 | Eddison | |
| 2002/0074167 | A1 | 6/2002 | Plop | |
| 2002/0170749 | A1 | 11/2002 | Hoyer et al. | |
| 2003/0016164 | A1 | 1/2003 | Finke et al. | |
| 2004/0062658 | A1 | 4/2004 | Beck et al. | |
| 2004/0108138 | A1 | 6/2004 | Cooper et al. | |
| 2004/0178003 | A1 | 9/2004 | Riet | |
| 2006/0243493 | A1 * | 11/2006 | El-Rayes et al. | 175/107 |
| 2008/0164062 | A1 * | 7/2008 | Brackin et al. | 175/24 |

FOREIGN PATENT DOCUMENTS

| | | |
|---|---|---|
| EP | 069530 | 1/1983 |
| EP | 0069530 A2 | 1/1983 |
| EP | 1075582 B1 | 8/2004 |
| WO | 9950524 | 10/1999 |
| WO | 0024997 A1 | 5/2000 |
| WO | 0204997 | 1/2002 |

OTHER PUBLICATIONS

R&M Energy Systems, "Stator Life of a Positive Displacement Down-Hole Drilling Motor," pp. 1-11, A Unit of Robbins & Myers, Inc., Conroe, Texas.
PCT International Search Report for Appl. No. PCT/US2008/078430 dated Jun. 4, 2009; (pp. 8).

* cited by examiner

*Primary Examiner*—David J Bagnell
*Assistant Examiner*—James G Sayre
(74) *Attorney, Agent, or Firm*—Conley Rose, P.C.

(57) ABSTRACT

A downhole motor assembly for driving a drill bit. The assembly includes a hydraulic drive section with a stator and a rotor located inside the stator to form a flow path between the stator and the rotor. Fluid flowing through the flow path in response to a pressure differential across the hydraulic drive section creates an operative force to rotate the drill bit. The assembly also includes a regulation mechanism that includes a valve and a fluid flow diversion bore for diverting at least some fluid from the flow path when the pressure differential across the hydraulic drive section is greater than or equal to a transition pressure differential.

17 Claims, 14 Drawing Sheets

DOWNHOLE MOTOR ASSEMBLY AND METHOD FOR TORQUE REGULATION

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND

A progressive displacement motor (PDM), sometimes referred to as a mud motor or downhole motor; converts hydraulic energy of a fluid such as drilling mud into mechanical energy in the form of rotational speed and torque output, which may be harnessed for a variety of applications such as downhole drilling. A PDM generally comprises a hydraulic drive section, a bearing assembly, and driveshaft. The hydraulic drive section, also known as a power section or rotor-stator assembly, includes a helical rotor disposed within a stator. The driveshaft is coupled to the rotor and is supported by the bearing assembly. Drilling fluid or mud is pumped under pressure between the rotor and stator, causing the rotor, as well as the drill bit coupled to the rotor, to rotate relative to the stator. In general, the rotor has a rotational speed proportional to the volumetric flow rate of pressurized fluid passing through the hydraulic drive section.

As shown in FIGS. 1 and 2, a conventional hydraulic drive section 10 comprises a helical-shaped rotor 30, typically made of steel that may be chrome-plated or coated for wear and corrosion resistance, disposed within a stator 20, typically a heat-treated steel tube 25 lined with a helical-shaped elastomeric insert 21. The helical-shaped rotor 30 defines a set of rotor lobes 37 that intermesh with a set of stator lobes 27 defined by the helical-shaped insert 21. As best shown in FIG. 2, the rotor 30 typically has one fewer lobe 37 than the stator 20. When the rotor 30 and the stator 20 are assembled, a series of cavities 40 are formed between the outer surface 33 of the rotor 30 and the inner surface 23 of the stator 20. Each cavity 40 is sealed from adjacent cavities 40 by seals formed along the contact lines between the rotor 30 and the stator 20. The central axis 38 of the rotor 30 is offset from the central axis 28 of the stator 20 by a fixed value known as the "eccentricity" of the rotor-stator assembly.

During operation of the hydraulic drive section 10, fluid is pumped under pressure into one end of the hydraulic drive section 10 where it fills a first set of open cavities 40. A pressure differential across the adjacent cavities 40 forces the rotor 30 to rotate relative to the stator 20. As the rotor 30 rotates inside the stator 20, adjacent cavities 40 are opened and filled with fluid. As this rotation and filling process repeats in a continuous manner, the fluid flows progressively down the length of hydraulic drive section 10 and continues to drive the rotation of the rotor 30. A driveshaft (not shown) coupled to the rotor 30 is also rotated and may be used to rotate a variety of downhole tools such as drill bits.

As shown in FIG. 3, a simplified version of a conventional downhole drilling system 50 comprises a rig 51, a drill string 52, and a PDM 53 coupled to a conventional drill bit 54. PDM 53 includes hydraulic drive section 10 previously described, a bent housing 56, a bearing pack 57, and a driveshaft 58 coupled to the drill bit 54. The PDM 53 forms part of the bottomhole assembly (BHA) and is disposed between the lower end of the drill string 52 and the drill bit 54. The hydraulic drive section 10 converts drilling fluid pressure pumped down the drill string 52 into rotational energy at the drill bit 54. With force or weight applied to the drill bit 54 via the drill string 52 and/or the PDM 53, also referred to as weight-on-bit (WOB), the rotating drill bit 54 engages the earthen formation and proceeds to form a borehole 60 along a predetermined path toward a target zone. As the drill bit 54 engages the formation, resistive torques generally opposing the rotation of the drill bit 54 and the rotor 30 are applied to the drill bit 54 by the formation. The drilling fluid or mud pumped down the drill string 52 and through the PDM 53 passes out of the drill bit 54 through nozzles positioned in the bit face. The drilling fluid cools the bit 54 and flushes cuttings away from the face of bit 54. The drilling fluid and cuttings are forced from the bottom 61 of the borehole 60 to the surface through an annulus 65 formed between the drill string 52 and the borehole sidewall 62.

Damage and potential failure of the hydraulic drive section of a PDM (e.g., hydraulic drive section 10), may occur for a variety of reasons. One common failure mode is stalling. Referring now to FIG. 4, a plot or graph 80 illustrates the general relationship between the WOB 81 applied to the drill bit 54, the resistive torques 82 applied to the drill bit 54 by the formation, and the rotational speed 83 of the drill bit 54, expressed in terms of revolutions per minute (RPM), for hydraulic drive section 10 previously described. As shown in FIG. 4, hydraulic drive section 10 has a stall torque 82*a*, which represents the resistive torque 82 applied to the drill bit 54 by the formation that is sufficient to cause hydraulic drive section 10 to stall for the hydraulic drive section 10 in a given condition. In general, the stall torque (e.g., stall torque 82*a*) for a particular hydraulic drive section (e.g., hydraulic drive section 10) will depend on a variety of factors such as the drive section size and geometry, the stator-rotor lobe configuration, the condition of the seal material at the stator and rotor interface, etc.

Referring still to FIG. 4, the WOB vs. resistive torque curve 85 for hydraulic drive section 10 graphically illustrates, as WOB 81 increases, the resistive torque 82 acting on the drill bit 54 also increases. Although the resistive torque 82 increases, if pumps at the surface maintain a constant volumetric flow rate of drilling fluid through the hydraulic drive section 10 (i.e., the surface pumps can impose sufficient energy into the drilling fluid to overcome the resistive torque 82), then the rotational speed 83*a* of the drill bit 54 will remain substantially the sane. However, at a sufficient WOB, referred to herein as stall WOB, the resistive torque 82 acting on the drill bit 54 achieves the stall torque 82*a*. At stall torque 82*a*, the hydraulic energy of the drilling mud is insufficient to overcome the resistive torque 82, and consequently, rotor 30 stops rotating relative to the stator 20. In other words, at the stall torque 82*a*, the surface pumps cannot impose sufficient energy into the drilling fluid to overcome the resistive torque 82, and therefore, the drill bit rotational speed 83*a* drops abruptly to zero. The sudden and near immediate decrease of the rotational speed 83*a* of the drill bit to zero is typically characterized as a "hard stall", as opposed to a more gradual reduction in the rotational speed of a drill bit, which may be characterized as a "soft stall".

Referring now to FIGS. 1-4, in the case of an abrupt or "hard" stall, the drastic change in the rotational speed and momentum of rotor 30 may result in significant and unpredictable impact forces and torques imposed on stator 20 by rotor 30. Such impact forces and torques may cause the mechanical failure of the elastomeric material forming the liner 21 of stator 20. For instance, if the elastomeric material forming liner 21 is loaded beyond its stress and strain limits, portions of the elastomer may tear or break off. Moreover, the stall forces and torques may cause portions of the elastomeric liner 21 to de-bond or become separated (e.g., delaminated) from tube 25. Moreover, as the relative rotational speed of rotor 20 decreases, fluid flow through hydraulic drive section 10 of PDM 53 decreases. As drilling fluid continues to be pumped down the drill string, but less fluid flows through hydraulic drive section 10, a pressure differential across hydraulic drive section 10 increases. If the pressure differential across hydraulic drive section 10 is sufficient, the relatively higher pressure drilling fluid at the upper end of PDM 53 may break the seals between rotor 30 and stator 20 at a relatively high fluid velocity, potentially washing away the elastomeric material forming liner 21. Damage(s) from motor stall often result in a reduction in the power conversion capability of PDM 53, thereby also reducing the rate of penetration (ROP) of drill bit 54 powered by PDM 53.

In general, the cost of drilling a borehole is proportional to the length of time it takes to drill to the desired depth. The time required to drill the well, in turn, is greatly affected by the number of times the entire string of drill pipes, which may be miles long, must be retrieved from the borehole, section by section in order to repair or replace a damaged hydraulic drive section of a PDM. Once the drill string has been retrieved and the rotor and/or stator is repaired or replaced, the entire string must be constructed section by section and lowered into the borehole. As is thus obvious, this process, known as a "trip" of the drill string, requires considerable time, effort and expense. Because drilling costs are typically thousands of dollars per hour, it is thus always desirable to avoid or reduce the likelihood of damaging the hydraulic drive section of a downhole PDM.

Accordingly, there remains a need for apparatus and methods to increase the durability and reliability of a PDM. Such apparatus and methods would be particularly well received if they offered the potential to reduce the likelihood of a "hard" stall and/or limit damage to the elastomeric liner of the stator of the downhole motor assembly as the relative rotational speed of the rotor and stator decreases wider excessive resistive torque from the bit.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
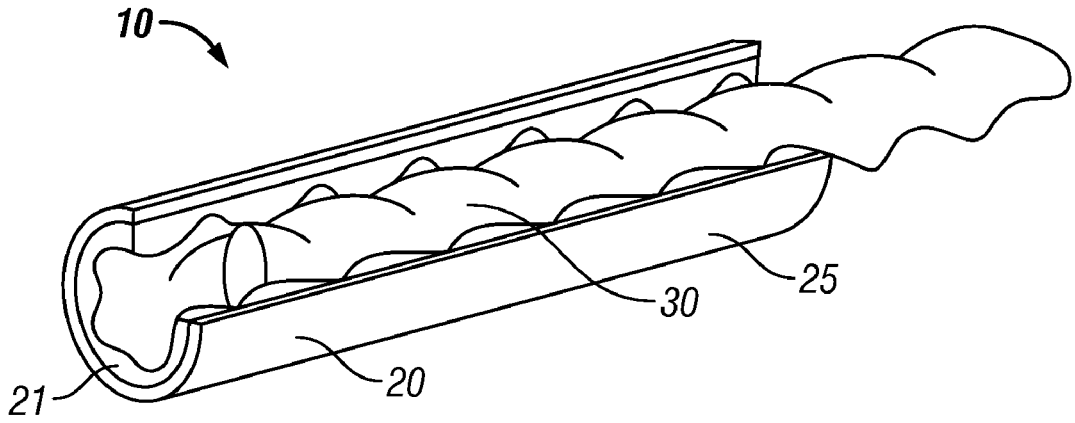
FIG. 1 (Prior Art)
FIG. 1 is a perspective, partial cut-away view of a conventional hydraulic drive section of a progressive displacement motor.
Figure 2:
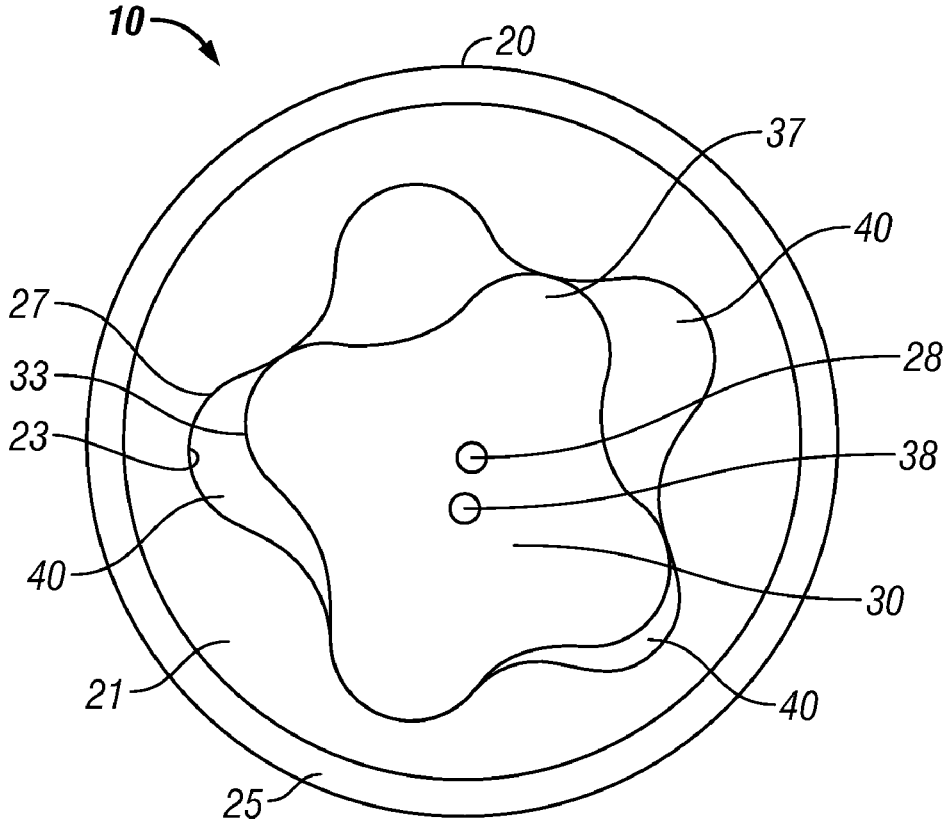
FIG. 2 (Prior Art)
FIG. 2 is a cross-sectional end view of the hydraulic drive section of FIG. 1.
Figure 3:
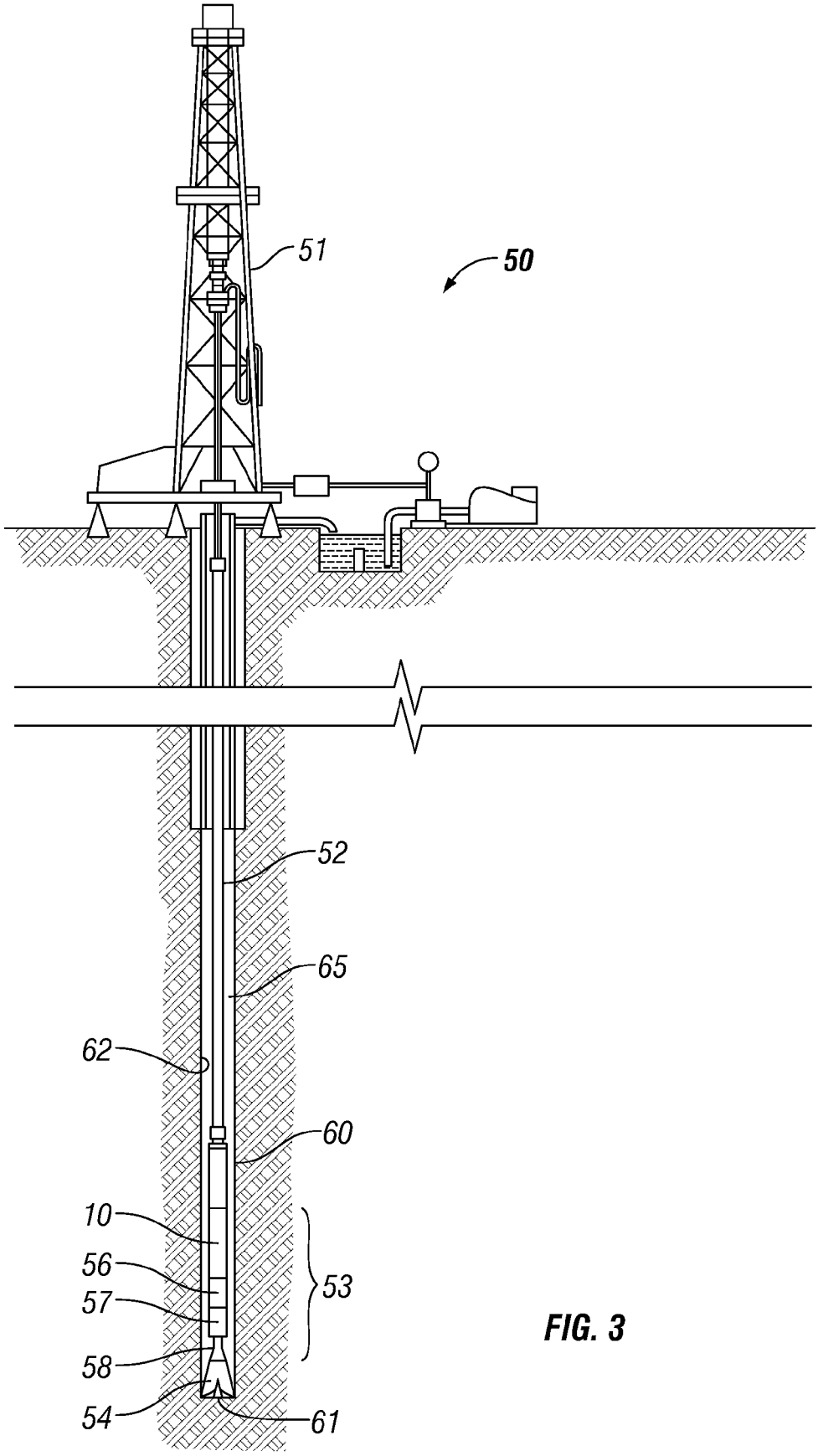
FIG. 3 is a schematic view of a conventional drilling system including the hydraulic drive section of FIG. 1.
Figure 4:
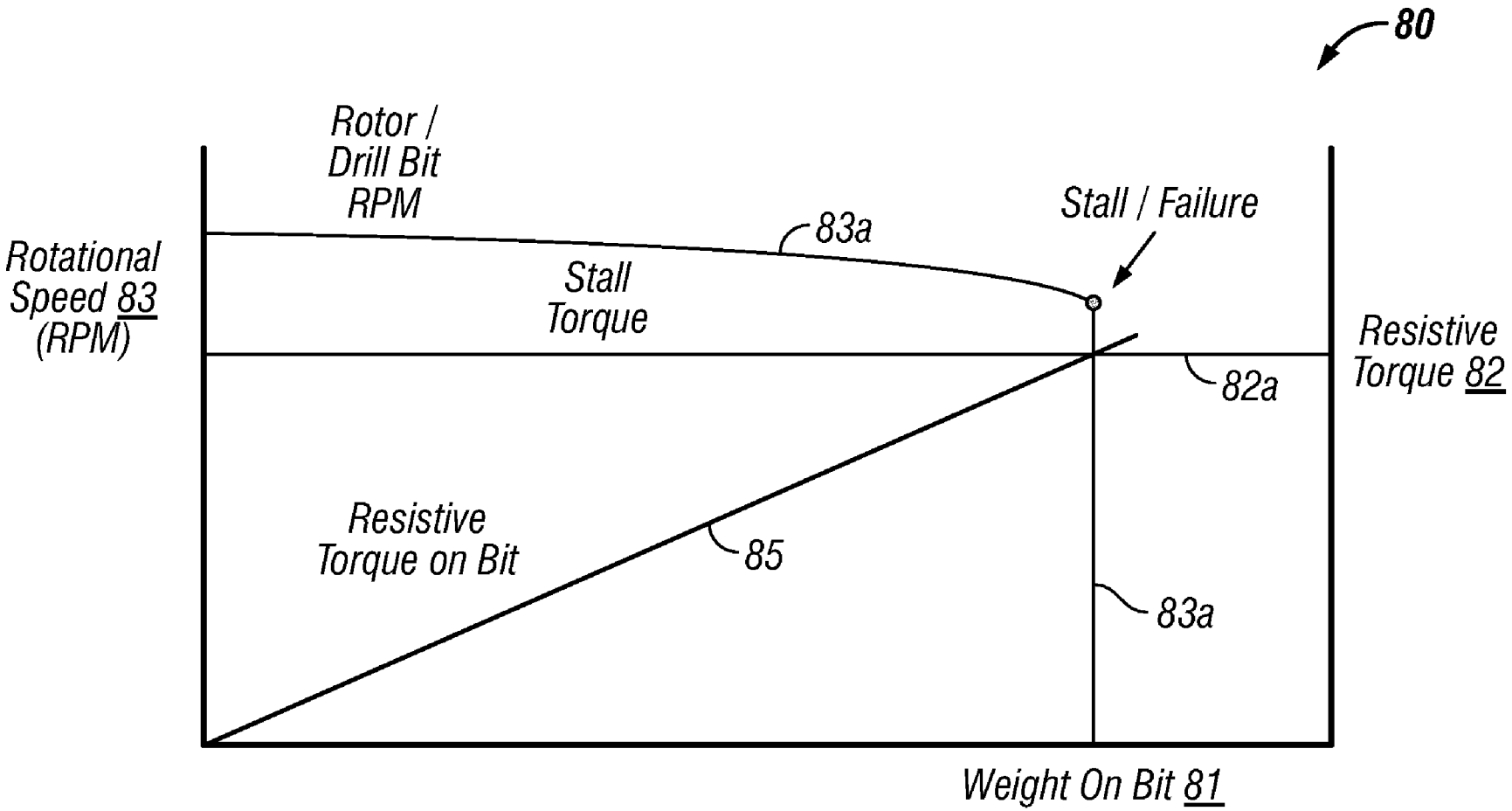
FIG. 4 is a graphical representation illustrating the relationship between weight-on-bit, rotor/drill bit RPM, and resistive torque-on-bit for a drill bit powered by a conventional PDM.

In the drawings and description that follows, like parts are marked throughout the specification and drawings with the same reference numerals, respectively. The drawing FIGS. are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 5:
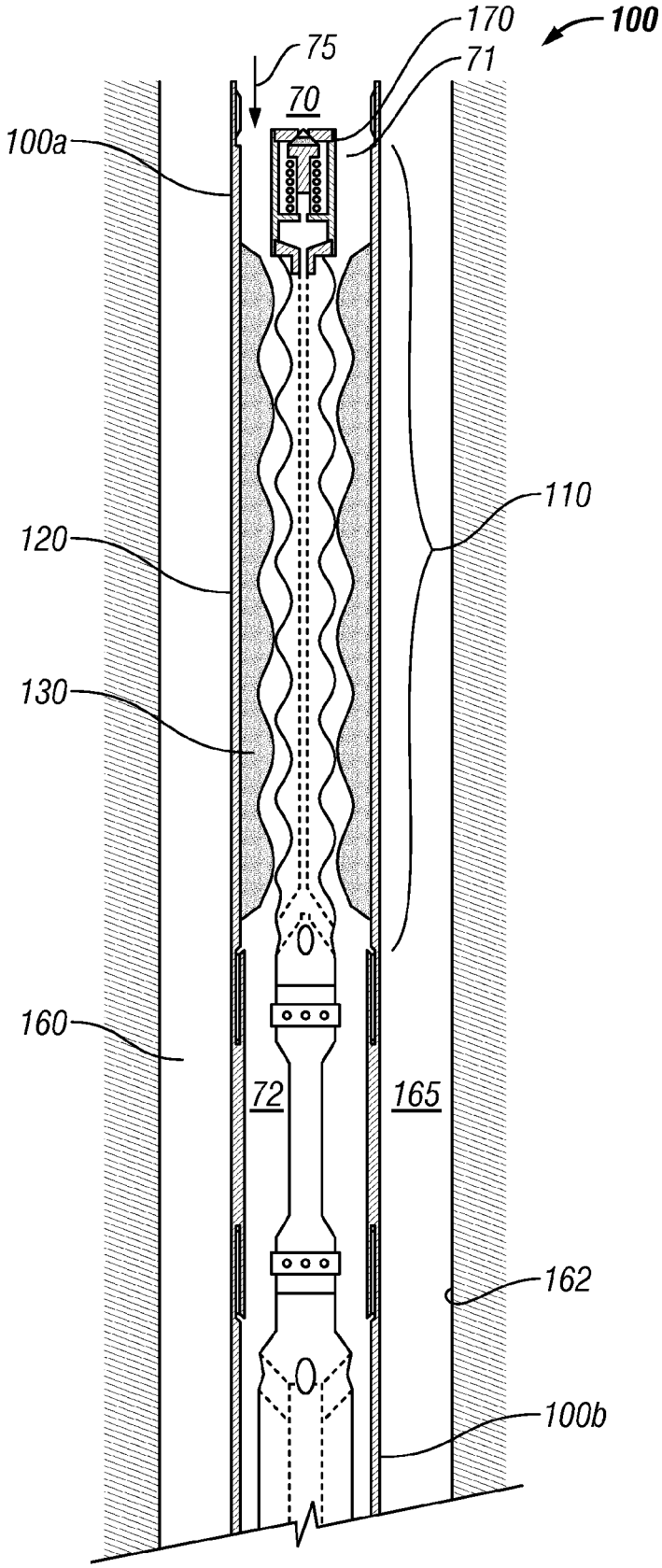
FIG. 5 is a partial cross-sectional view of an embodiment of a downhole motor assembly.

Referring to FIG. 5, an embodiment of a progressive displacement motor (PDM) or downhole mud motor 100 disposed within a borehole 160 is shown. PDM 100 has an upper or top-hole end 100*a* coupled to the lower end of a drill string (not shown) and a lower or bottom-hole end 100*b* coupled to a drill bit (not shown). PDM 100 includes a rotor-stator assembly or hydraulic drive section 110 described in more detail below. Although PDM 100 is coupled to and drives a drill bit in this embodiment, in other embodiments, PDM 100 may be coupled to and drive alternative downhole tools.

Together, the drill string and PDM 100 define an inner drilling fluid flow passage 70 that may be described as being divided into a first or upper region 71 generally above hydraulic drive section 110, and a second or lower region 72 generally below hydraulic drive section 110. Drilling fluid, or mud, flows under pressure down the drill string through flow passage 70 in a direction represented by arrows 75. The drilling fluid then flows through across hydraulic drive section 110 from first region 71 to second region 72. As will be explained in more detail below, hydraulic drive section 110 is configured to rotate the drill bit to form borehole 160 as drilling fluid flows from first region 71 to second region 72. The drilling fluid flows through the remainder of PDM 100 to the drill bit where it passes through nozzles disposed in the face of the drill bit into an annulus 165 between PDM 100 and the sidewall 162 of borehole 160. Once the drilling fluid exits the drill bit, it returns to the surface via the annulus 165. In this manner, drilling fluid may be continuously pumped from the surface through flow passage 70, across hydraulic drive section 110, out of the drill bit, and back to the surface via annulus 165.

Figure 6:
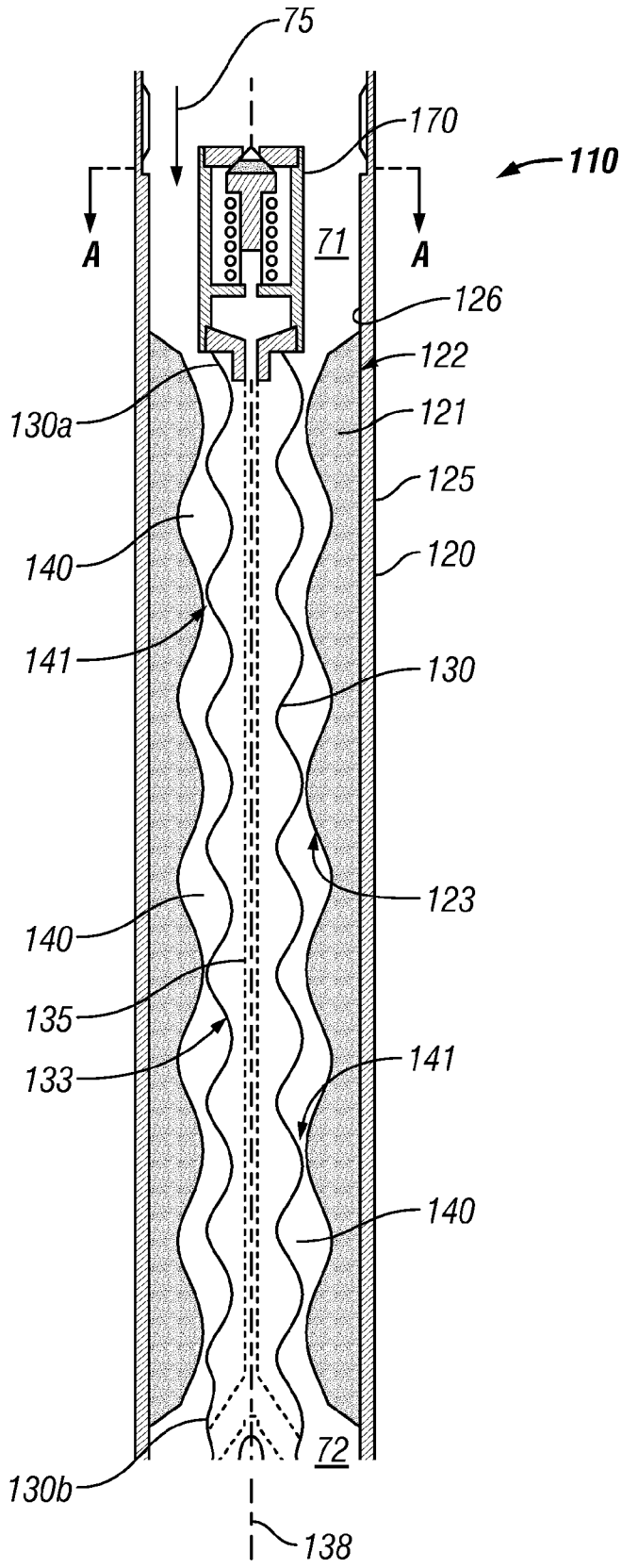
FIG. 6 is an enlarged partial cross-sectional view of the hydraulic drive section of the downhole motor assembly of FIG. 5.
Figure 7:
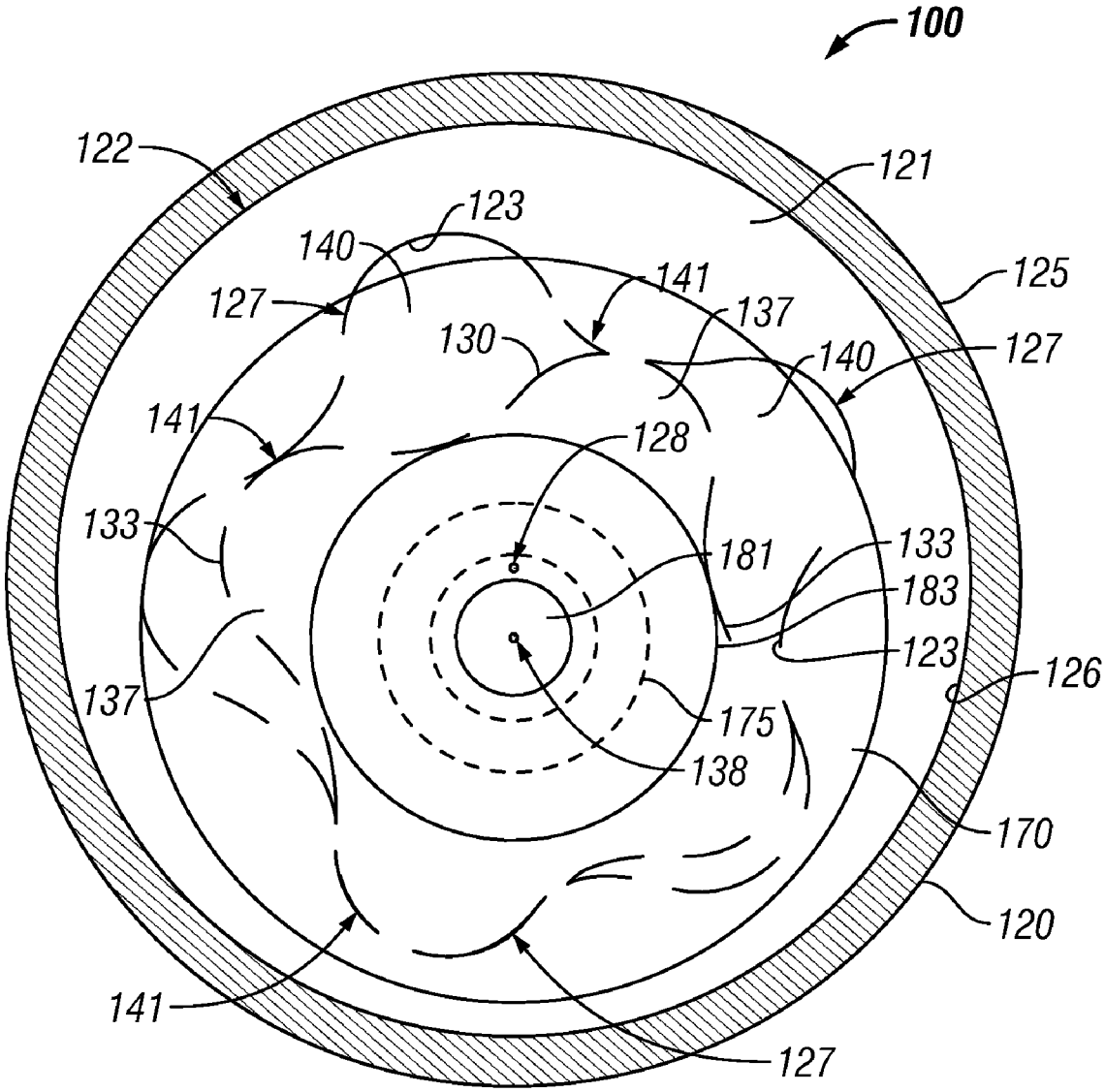
FIG. 7 is a partial cross-sectional view of the hydraulic drive section of FIG. 6 taken along lines A-A.

Referring now to FIGS. 6 and 7, hydraulic drive section 110 includes a helical rotor 130 disposed within a mating stator 120. Stator 120 has a longitudinal axis 128 (FIG. 7) and includes a radially inner liner or insert 121 of variable thickness disposed within, and surrounded by, a radially outer housing 125. In this embodiment, housing 125 has a uniform radial thickness and includes a cylindrical inner surface 126 that engages the cylindrical outer surface 122 of liner 121. Specifically, the shape and size (e.g., radius) of the inner surface 126 of housing 125 corresponds to the shape and size (e.g., radius) of the outer surface 122 of liner 121 such that the outer surface 122 of liner 121 statically engages the inner surface 120 of housing 125. In particular, liner 121 is fixed to housing 125 such that liner 121 does not move rotationally or translationally relative to housing 125. Liner 121 may be fixed to housing 125 by any suitable means including, without limitation, a chemical bond, an adhesive, an interference fit, screws or bolts, or combinations thereof. The inner surface 123 of liner 121 has a helical shape defining five lobes 127 in this embodiment. Although this embodiment includes a variable thickness liner 121, in other embodiments, the stator may include a uniform thickness or constant wall thickness liner disposed within a housing having a helical inner surface.

In general, housing 125 and liner 122 may each be made of any suitable material including, without limitation, a metal or metal alloy (e.g., aluminum, stainless steel, etc.), a non-metal (e.g., a polymer, ceramic, etc.) a composite (e.g., carbon-epoxy composite), or combinations thereof. However, since housing 125 experiences harsh downhole conditions, and further, since housing 125 must be capable of transferring weight-on-bit (WOB) from the drill string to the drill bit (i.e., capable of bearing relatively large loads), housing 125 preferably comprises a relatively durable, corrosion resistant, and rigid material such as stainless steel. Further, since the inner surface 123 of liner 122 is intended to periodically sealingly engage with rotor 130 as rotor 130 rotates within stator 120, liner 122 preferably comprises a compliant material capable of partially deforming to form a fluid tight seal such as an elastomer.

Referring still to FIGS. 6 and 7, rotor 130 has a longitudinal axis 138, and includes an upper or top-hole end 130*a*, a lower or bottom-hole end 130*b*, and a fluid flow diversion bore 135 extending between ends 130*a*, 130*b*, Rotor 130 has a helical-shaped outer surface 133 defining four lobes 137 as best shown in FIG. 7. Thus, in this embodiment, rotor 130 has one fewer lobe 137 than stator 120. Although this embodiment of hydraulic drive section 110 has a four in five lobe configuration, meaning a four lobe rotor 130 disposed within a five lobe stator 120, it should be appreciated that other embodiments may include other lobe numbers and combinations. For instance, the hydraulic drive section may include a two in three lobe configuration, or a three in four lobe configuration.

Helical-shaped outer surface 133 of rotor 130 is adapted to periodically sealingly engage with the inner surface 123 of stator 120 as rotor 130 rotates about its axis 138 and also rotates about stator axis 128. In particular, when stator 120 and rotor 130 are assembled, a series of cavities 140 are formed between the outer surface 133 of rotor 130 and the inner surface 123 of stator 120. Each cavity 140 is periodically sealed from adjacent cavities 140 by seals 141 formed along the contact lines between rotor 130 and stator 120. Thus, as rotor 130 rotates within stator 120 drilling fluid flows between regions 71 and 72 through hydraulic drive section 110 along the series of cavities 140 that form between the outer surface 133 of rotor 130 and the inner surface 123 of stator 120.

Referring now to FIGS. 6-10, a pressure differential regulation mechanism 170 is coupled to top-hole end 130*a* of rotor 130. Pressure differential regulation mechanism 170 comprises a bypass relief valve 180 in fluid communication with fluid flow diversion bore 135 disposed within a generally cylindrical body 171. Body 171 has an upper or free end 171*a* and a lower or rotor end 171*b* that is axially coupled to upper end 130*a* of rotor 130. More specifically, rotor end 171*b* of body 171 includes an axial extension that is threaded into a mating recess provided in upper end 130*a* of rotor 130. Thus, body 171 is fixed to rotor 130 such that body 171 does not move translationally or rotationally relative to rotor 130. In other embodiments, body 171 may be molded, machined, or cast as an integral part of rotor 130.

Although body 171 is described as being coupled to rotor 130 via mating threads in this embodiment, in general, body 171 may be coupled to rotor 130 by other suitable means including, without limitation, a welded joint, bolts, a retaining pin, or combinations thereof. Moreover, although bypass relief valve 180 is shown and described as being coupled to the upper end 130*a* of rotor 130, in other embodiments, the bypass relief valve (e.g., bypass relief valve 180) may be coupled to the lower end of the rotor (e.g., lower end 130*b* of rotor 130) and be disposed within the rotor to achieve the potential benefits described in more detail below.

Figure 8:
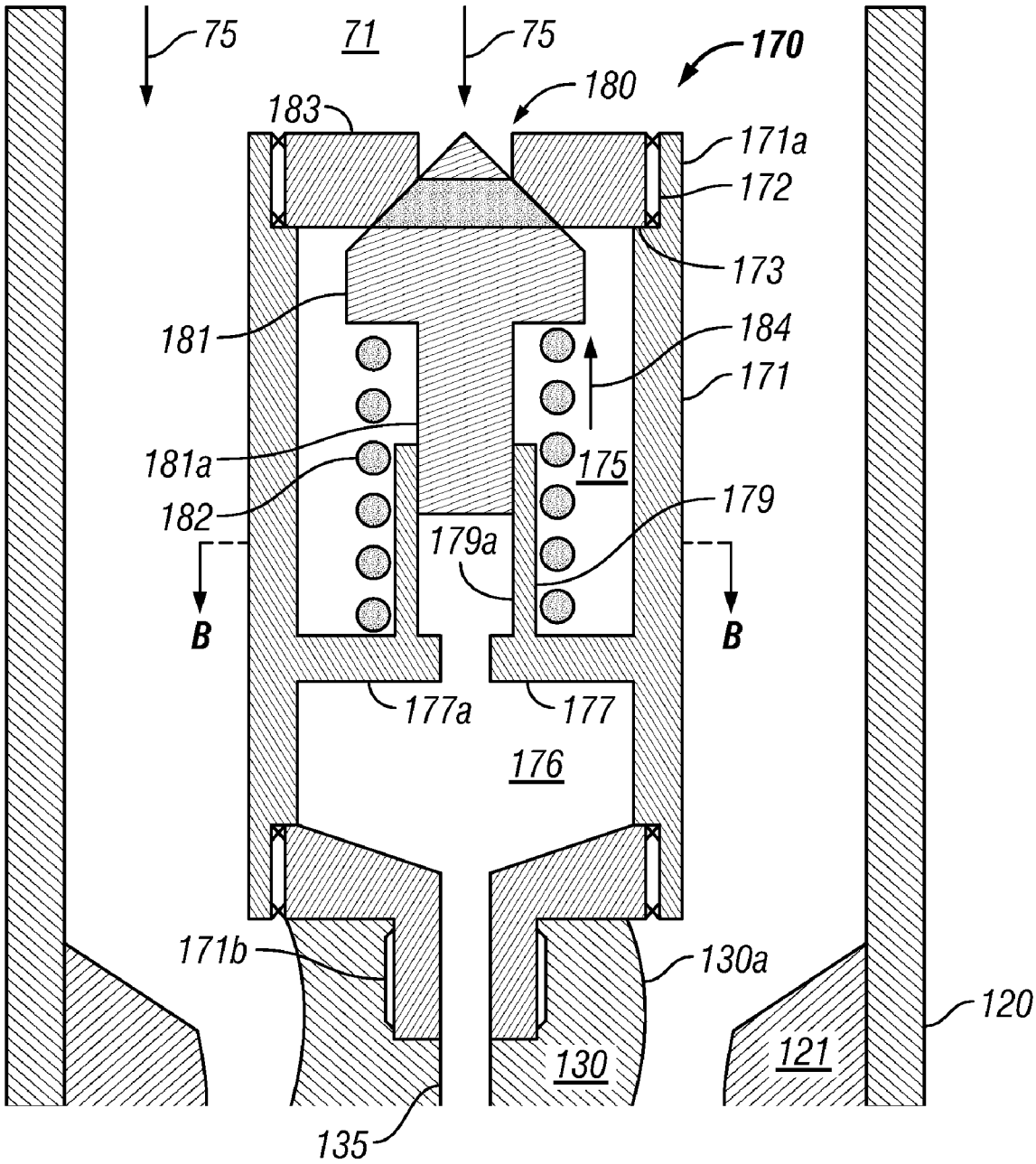
FIG. 8 is a cross-sectional view of the pressure differential regulation mechanism of FIG. 6 in the closed position.
Figure 9:
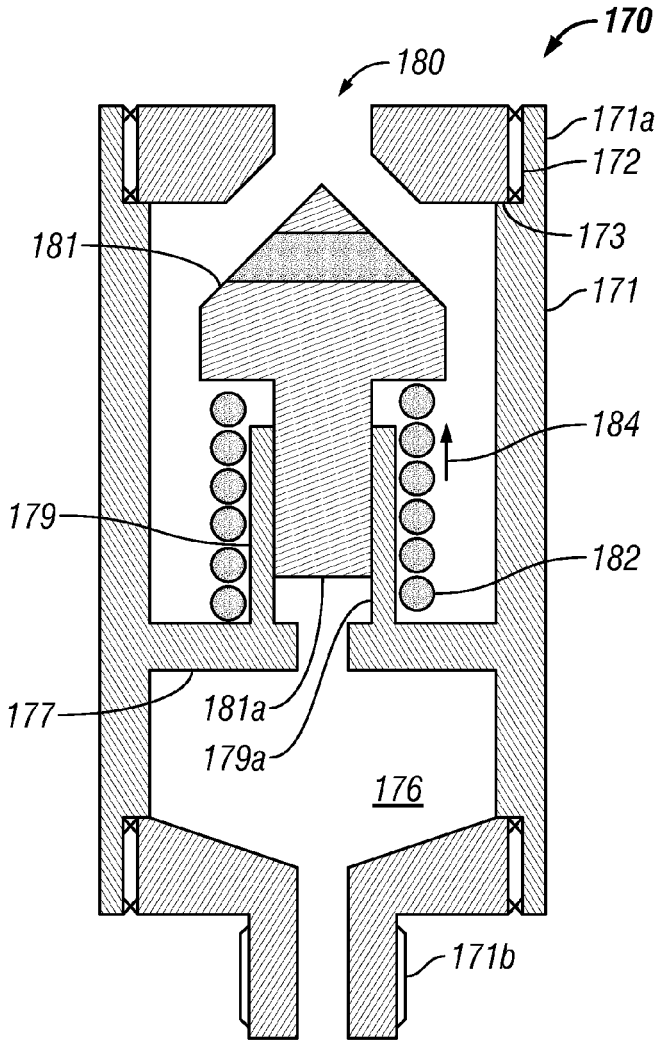
FIG. 9 is a cross-sectional view of the pressure differential regulation mechanism of FIG. 6 in the opened position.
Figure 10:
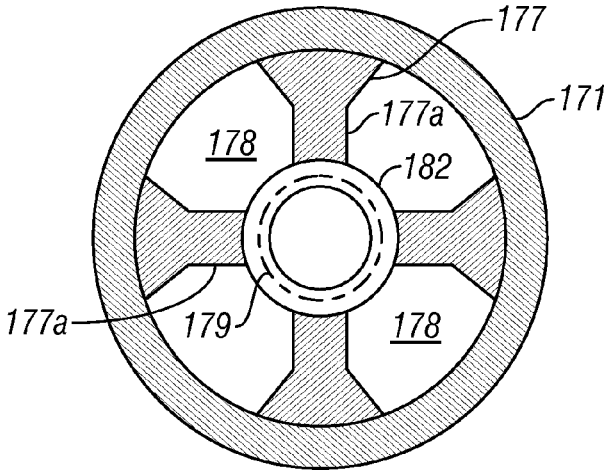
FIG. 10 is a cross-sectional view of the pressure differential regulation mechanism of FIG. 8 taken along lines B-B.

Referring specifically to FIGS. 8-10, body 171 includes a upper valve cavity 175 and a lower flow cavity 176. A valve support member 177 is positioned between cavities 175, 176 and includes a plurality of flow passages 178 defined by a plurality of radially extending support arms 177*a* (FIG. 10). In addition, valve support member 177 includes a cylindrical actuator guide 179 extending axially from arms 177*a* toward free end 171*a*. Valve cavity 175 is in fluid communication with flow cavity 176 via passages 178, and flow cavity 176 is in fluid communication with diversion bore 135. Thus, valve cavity 175 is in fluid communication with diversion bore 135 via passages 178 and cavity 176.

Bypass relief valve 180 is disposed within valve cavity 175 and regulates the flow of drilling fluid between first region 71 and second region 72 through diversion bore 135. In this embodiment, bypass relief valve 180 comprises a valve actuator 181 and a biasing member 182 that biases valve actuator 181 into engagement with an annular retaining ring 183. In this embodiment, biasing member 182 is a coiled spring radially disposed around valve guide 179 and axially positioned between support arms 177*a* and valve actuator 181. Biasing member 182 provides a biasing force represented by arrow 184 that biases valve actuator 181 into engagement with retaining ring 183, Valve guide 179 guides the motion of valve actuator 181 in response to forces applied to valve actuator 181 (e.g., biasing force, etc.). In particular, valve guide 179 includes a cylindrical axial bore 179*a* within which a mating cylindrical tail portion 181*a* of actuator 181 is axially disposed. In this manner, valve guide 179 restricts valve actuator 181 to axial movement relative to body 171.

Referring still to FIGS. 8-10, annular retaining ring 183 is disposed in a counterbore 172 in free end 171*a* of body 171 against an annular shoulder 173 and is coupled to body 171, thereby retaining valve actuator 181 and biasing member 182 within valve cavity 175. In general, retaining ring 183 may be coupled to body 171 by any suitable means including, without limitation, mating threads, a welded joint, bolts, or combinations thereof. In this embodiment, retaining ring 183 is fixed to body 171 such that retaining ring 183 does not move translationally or rotationally relative to body 171. In some embodiments, retaining ring 183 is releasably fixed to body 171 such that valve actuator 181 and biasing member 182 can be accessed and removed from valve cavity 175 for repairs and/or replacement. In some embodiments, an annular O-ring type seal may be positioned between the retaining ring (e.g., retaining ring 183) and the body (e.g., body 171) to restrict and/or prevent the flow of drilling fluid therebetween.

Referring now to FIGS. 8 and 9, bypass relief valve 180 has a closed position shown in FIG. 8, in which valve actuator 181 is biased into engagement with retaining ring 183, thereby restricting and/or preventing fluid communication between region 71 and region 72 via diversion bore 135. Thus, when bypass relief valve 180 is in the closed position, drilling fluid pumped from the surface down flow passage 70 in the direction of arrows 75 flows through the series of cavities 140 that form between rotor 130 and stator 120, but is restricted by bypass relief valve 180 from flowing into diversion bore 135. In addition, bypass relief valve 180 has an opened position shown in FIG. 9 in which valve actuator 181 is not fully engaging retaining ring 183, and thus, fluid communication between region 71 and region 72 via diversion bore 135 is permitted. When bypass relief valve 180 is in the opened position, drilling fluid pumped from the surface down flow passage 70 is permitted to flow through the series of cavities 140 between rotor 130 and stator 120, and is also permitted to flow through diversion bore 135. Drilling fluid that passes from region 71 to region 72 via diversion bore 135 effectively bypasses hydraulic drive section 110. Consequently, diversion bore 135 may also be described as a bypass flow passage.

Referring again to FIGS. 6-9, in this embodiment, valve 180 is actuated between the closed position and the opened position by the pressure differential or drop across hydraulic drive section 110 (i.e., the pressure differential between region 71 and region 72). In general, valve 180 is biased to the closed position by biasing member 182 which generates biasing force 184. However, when the pressure differential between regions 71, 72 is sufficient to overcome biasing force 184, valve actuator 181 is forced downward and out of engagement with retaining ring 183, thereby opening valve 180 (FIG. 9). However, when pressure differential between regions 71, 72 is insufficient to overcome biasing force 184, valve actuator 181 will remain biased to the closed position and in positive engagement with retaining ring 183 (FIG. 8). Since actuation of valve 180 between the opened and closed positions depends exclusively on the pressure differential across hydraulic drive section 110 in this embodiment, valve 180 may be described as self-regulating. In other words, in this embodiment, valve 180 does not require input from any external controls directing it to actuate.

By controlling the biasing force 184, the pressure differential between regions 71, 72 at which bypass valve 180 actuates can be tailored and controlled. In some embodiments, biasing force 184 may be a constant force. For example, biasing member 182 may be a spring having a constant spring coefficient K. However, in other embodiments, biasing force 184 may vary linearly or non-linearly. For example, biasing member 182 may be a spring configured to provide an increasing spring force as axial compression increases. In such an embodiment, the more bypass relief valve 180 opens, the lower the pressure differential necessary for bypass relief valve 180 to open further. As will be explained in more detail below, in this embodiment, biasing force 184 is selected such that bypass relief valve 180 opens prior to stall conditions, thereby offering the potential to mitigate potential damage(s) resulting from stall.

Although bypass relief valve 180 is shown and described as including a valve actuator 181 having tail portion 181*a* axially disposed within guide bore 179*a* and biasing member 182 that biases actuator 181 into the closed position, in general, the bypass relief valve may comprise any suitable valve capable of regulating the flow of drilling fluid through a diversion bore based on a pressure differential across the relief valve. Example of an alternative valve types include, without limitation, a biased piston-cylinder valve, biased ball valve, etc.

Referring to FIGS. 5-9, during operation of hydraulic drive section 110 high pressure drilling fluid is pumped down flow passage 70 in the direction of arrows 75 to region 71. The fluid pressure in region 71 is the sum of the pressure created by the drilling fluid column head at region 71 (i.e., the pressure resulting from the column of drilling fluid disposed above region 71) and the pressure imposed on the drilling fluid by the mud pumps that pump the drilling fluid through drill string flow passage 70. The fluid pressure at region 72 is generally less than the fluid pressure at region 71 since hydraulic drive section 110 at least partially isolates region 72 from the column head of drilling fluid in region 71 and the pressure imposed by the mud pumps. Thus, there is a pressure differential or drop across hydraulic drive section 110.

If the pressure differential across hydraulic drive section 110 is insufficient to overcome biasing force 184, then valve 180 will remain biased to the closed position shown in FIG. 8. When valve 180 is in the closed position, relatively higher pressure fluid in region 71 is restricted from passing through valve 180 and diversion bore 135. Consequently, the pressurized fluid in region 71 will flow through the flow path created by the series of cavities 140 formed between rotor 130 and stator 120. The pressure differential across the adjacent cavities 140 imposes a rotational force and torque to rotor 130, which causes rotor 130 to rotate relative to stator 120. As rotor 130 rotates inside stator 120, adjacent cavities 140 are opened and filled with the high pressure drilling fluid. As this rotation and filling process repeats in a continuous manner; drilling fluid flows progressively down the length of hydraulic drive section 110 towards region 72 and continues to impose a rotational force and torque to rotor 130. The rotational force and torque are translated from rotor 130 to the drill bit coupled to rotor 130. With weight-on-bit applied to the drill rotating drill bit, the drill bit engages the formation and drills borehole 160. In this manner, hydraulic drive section 110 converts a drilling fluid pressure differential between region 71 and region 72 into operative force and torque-on-bit. In general, the differential pressure and volumetric flow rate of drilling fluid across hydraulic drive section 110 via cavities 140 is proportional to the operative rotational force and torque applied to the drill bit, and proportional to the rotational speed of the drill bit. Although the flow of drilling fluid from relatively higher pressure region 71 to relatively lower pressure region 72 seeks to relieve the pressure differential therebetween, the mud pumps at the surface continue to impose pressure to the drilling fluid within flow passage 70 and maintain the pressure differential between region 71 and region 72.

On the other hand, if the pressure differential or drop across hydraulic drive section 110 is sufficient to overcome biasing force 184, then valve 180 will transition to the opened position shown in FIG. 9. When bypass valve 180 is in the opened position, a portion of the pressurized fluid in region 71 is diverted through valve 180 and diversion bore 135, and a portion of the pressurized fluid in region 71 passes through cavities 140 between rotor 130 and stator 120. The portion of pressurized drilling fluid flowing from region 71 to region 72 via diversion bore 135 reduces the pressure differential therebetween, but bypasses cavities 140 and does not impose any rotational force or torque to rotor 130. However, the portion of pressurized drilling fluid flowing through cavities 140 between rotor 130 and stator 120 continues impose an operative rotational forces and torque on rotor 130. However, since the volumetric flow rate across hydraulic drive section 110 is divided between cavities 140 and diversion bore 135, the volumetric flow rate through cavities 140 alone is decreased. Thus, when valve 180 is actuated to the opened position by a sufficient pressure differential between regions 71, 72, the pressure differential therebetween is at least partially limited, and the rotational force and torques applied to rotor 130 and the drill bit are also limited.

When the pressure differential between regions 71, 72 sufficiently decreases (i.e., when the pressure differential across hydraulic drive section 110 cannot overcome biasing force 184), biasing force 184 will again bias valve actuator 181 into engagement with retailing ring 183, thereby reseating and closing valve 180. As previously described, when valve 180 is in the closed position, substantially all the volumetric flow rate of drilling fluid between regions 71, 72 is through cavities 140 between rotor 130 and stator 120. As the volumetric flow rate through cavities 140 increase upon closure of valve 180, the rotational forces and torques applied to rotor 130 and the drill bit will also increase.

In the case of excessive weight-on-bit and/or increased flow of drilling fluid through passage 70 from the surface, the pressure differential or drop across hydraulic drive section 110 may increase sufficiently to actuate valve 180 to open, thereby relieving the pressure differential across hydraulic drive section 110. In this manner, embodiments described herein offer the potential to reduce the likelihood of a "hard" stall and associated damage to the stator (e.g., stator 120).

Figure 11:
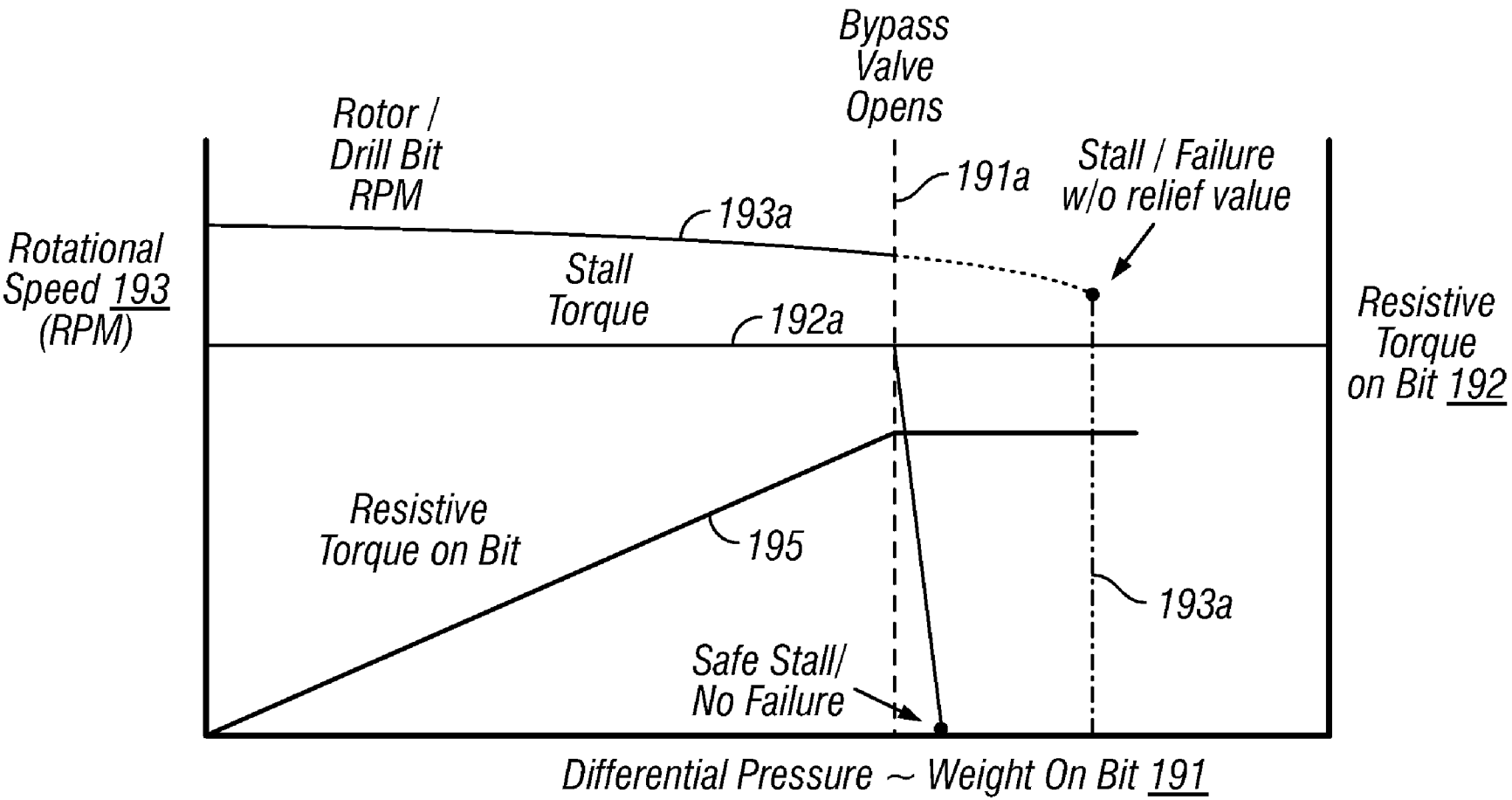
FIG. 11 is a graphical representation illustrating the relationship between weight-on-bit, rotor/drill bit RPM, and resistive torque-on-bit for a drill bit powered by the downhole motor assembly of FIG. 5.

For instance, referring now to FIG. 11, a plot or graph 190 illustrates the general relationship between the differential pressure 191 across the hydraulic drive section 110, the resistive torques 192 applied to the drill bit by the formation, and the rotational speed 193 of the drill bit, expressed in terms of revolutions per minute (RPM), for hydraulic drive section 110 previously described. As expressed in the graph, the differential pressure across the hydraulic drive section 110 is proportional to the WOB. As shown in FIG. 11, hydraulic drive section 110 has a "hard" stall torque 192*a*, which represents the resistive torque 192 applied to the drill bit by the formation that is sufficient to cause an uncontrolled "hard" stall of hydraulic drive section 110. At the stall torque 192*a*, the hydraulic energy in the drilling fluid pumped through hydraulic drive section 110 is insufficient to overcome the resistive torques 192 and the rotor 130 abruptly stops rotating relative to the stator 120, potentially resulting in damage to the liner 121. As the resistive torque 192 on the drill bit 130 increases, the differential pressure 191 across the hydraulic drive section 110 also increases and approaches the stall torque. However, the bypass relief valve 180 is configured to transition to the opened position at a pressure differential associated with a given pressure differential 191*a*, also referred to herein as the transition pressure differential 191*a* or transition torque, that is less than the otherwise hard stall torque 192*a* of the hydraulic drive section 110. Thus, the bypass relief valve 180 offers the potential to reduce the likelihood of ever reaching the stall/failure pressure differential. As shown, the resistive torque 192 on the drill bit increases and the differential pressure 191 increases until the transition differential pressure 191*a* is reached. At the transition differential pressure 191*a*, the bypass relief valve 180 opens, thereby at least partially relieving the pressure differential 191 across the hydraulic drive section 110. Consequently, there is a reduced likelihood of the differential pressure 191 will increase sufficiently such that the "hard" stall torque 192 is reached. Rather, at the transition pressure differential 191*a*, at least some of the drilling fluid bypasses hydraulic drive section 110 via diversion bore 135, thereby relieving the pressure differential across hydraulic drive section 110 and decreasing the volumetric flow rate of drilling fluid between the rotor 130 and stator 120. Thus, as opposed to a "hard" or abrupt stall, the increased diversion of drilling fluid through diversion bore 135 offers the potential for more controlled and gradual "soft" stall, or "safe" stall so that failure or damage to the hydraulic drive section 110 is less likely to occur. Additionally, once the "soft stall" occurs, the valve 180 being open allows the drilling fluid to continually bypass the hydraulic drive section 110, thus further decreasing the likelihood of damaging the hydraulic drive section 110 until the stall can be corrected.

In the case excessive WOB 191 contributes to the achievement of the transition differential pressure 191*a*, (i.e., excessive WOB 191 triggers bypass relief valve 180 to open), prior to or upon stall of the hydraulic drive section 110, the excessive WOB 191 may be reduced by pulling upward on the drill string just enough to reduce the applied force on the bit or WOB, thereby reducing the resistive torques 192 and allowing the rotor 130 to rotate more freely. The increased flow rate through cavities 140 in conjunction with volumetric flow through diversion bore 135 will reduce the pressure differential 191 across hydraulic drive device 110 until it can no longer overcome biasing force 184, in winch case valve 180 closes and the drilling fluid is restricted from flowing through diversion bore 135.

In the embodiment of pressure differential regulation mechanism 170 shown in FIGS. 6-8, diversion bore 135 provides a fluid flow bypass route between regions 71, 72. In other words, fluid flowing through diversion bore 135 effectively bypasses hydraulic drive section 110. The flow of fluid through diversion bore 135 is regulated by valve 180. Although diversion bore 135 shown in FIGS. 6-8 has an outlet in fluid communication with legion 72 immediately below hydraulic drive section 110, in other embodiments, the diversion bore (e.g., diversion bore 135) may not extend completely across the hydraulic drive section (e.g., hydraulic drive section 110), and may have an outlet at some intermediate position. For instance, the diversion bore may have a fluid outlet from intermediate the ends of the rotor, such as in the middle of the length of the rotor.

Although pressure differential regulation mechanism 170 and bypass relief valve 180 have been described as self-regulating, in other embodiments, the bypass relief valve (e.g., bypass relief valve 180) may be actuated between the opened and closed positions by an external actuator or valve control mechanism. Such a valve control mechanism may contain control electronics and software that receive and process valve control commands from surface, either directly or via downhole communications systems.

Figure 12:
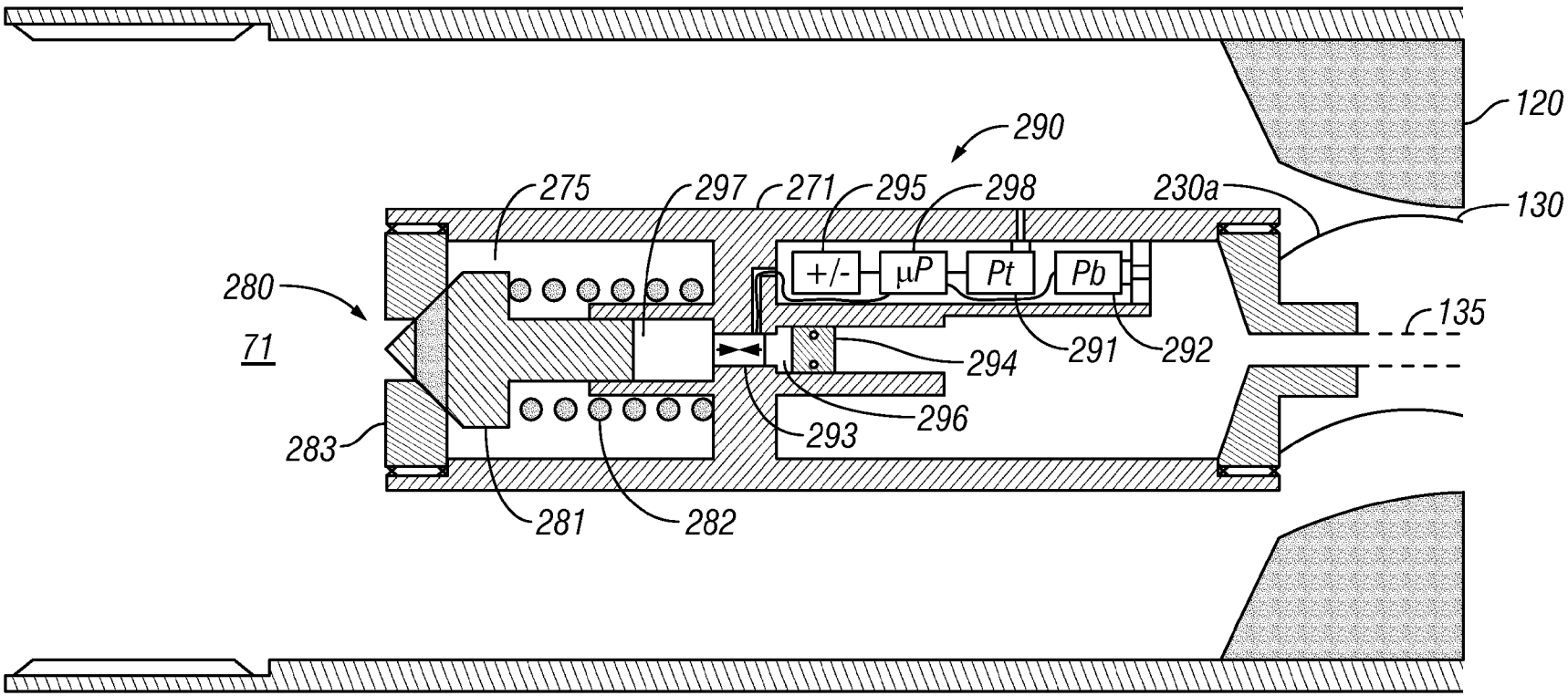
FIG. 12 is an enlarged cross-sectional view of an control mechanism for the bypass relief valve of FIG. 8.

Referring now to FIG. 12, an embodiment of an electronically controlled and actuated pressure differential regulation mechanism 270 is shown. Regulation mechanism 270 is similar to regulation mechanism 170 previously described. Namely, in this embodiment, regulation mechanism 270 is coupled to top-hole end 130*a* of a rotor 130 disposed within a stator 120. A fluid diversion bore 135 extends through rotor 130.

Pressure regulation mechanism 270 comprises a bypass relief valve 280 disposed within a valve cavity 275 of a body 271. Bypass relief valve 280 regulates the flow of drilling fluid between a first region 71 above the hydraulic drive section and a second region 72 below the hydraulic drive section via the fluid flow diversion bore 135. Valve 280 has a closed position in which an actuator 281 is in engagement with an annular retaining ring 283, thereby restricting fluid communication between region 71 and region 72 via diversion bore 135, and an opened position in which actuator 281 is not in engagement with retaining ring 283, thereby permitting fluid communication between region 71 and region 72 via diversion bore 135. However, unlike regulation mechanism 170 previously described, in this embodiment, regulation mechanism 270 includes an electronic valve control mechanism 290 that controls and actuates valve 280.

Valve control mechanism 290 includes a top pressure sensor or transducer 291 that measures the fluid pressure in region 71, a bottom pressure sensor or transducer that measures the fluid pressure in region 72, valve actuator controller 298, a bi-directional check valve 293, a balance piston 294, and a local power source 295. Balance piston 295 and check valve 293 define a sealed fluid filled cavity 296 extending therebetween. Further, the lower end of actuator 281 and check valve 293 define a sealed fluid filled cavity 297 extending therebetween. When check valve 293 is in the opened position, cavities 296, 297 are in fluid communication with each other. However, when check valve 293 is in the closed position, cavities 296, 297 are not in fluid communication. In this embodiment, cavities 296, 297 are filled with an essentially incompressible fluid.

Referring still to FIG. 12, valve actuator 281 transitions between the closed and opened positions in response to the pressure differential between region 71 and cavity 297. In this embodiment, valve actuator 281 is biased closed by biasing member 282. As long as the force generated by the fluid pressure in cavity 297 and the biasing force generated by biasing member 281 is greater than or equal to the force generated by the fluid pressure in region 71, then valve actuator 281 will remain in the closed position engaging ring 283. However, if the force generated by the fluid pressure in region 71 exceeds the force generated by the fluid pressure in cavity 297 and the biasing force generated by biasing member 282, then valve actuator 281 will transition to an opened position.

The fluid pressure in cavity 297 is regulated, in part, by check valve 293—when check valve 293 is closed, the volume of cavity 297 is substantially constant, thereby restricting actuator 281 from moving. However, when check valve 293 is opened, fluid in cavity 297 is free to flow into cavity 296, and thus, actuator 281 is permitted to move if sufficient force is applied to actuator 281 (i.e., force generated by fluid pressure in region 71 is greater than the biasing force generated by biasing member 282 and the force generated by the fluid pressure in region 297).

Bi-directional check valve 293 is directed to open and close by controller 298 in response to the pressure differential between regions 71, 72. In particular, pressure sensors 291, 292 measure the fluid pressures in regions 71, 72, respectively. The measured pressures are communicated to controller 298, such as by electrical signal. Controller 298 determines the pressure differential between regions 71, 72 by comparing the measured pressures, and then compares the pressure differential between regions 71, 72 to a threshold pressure differential. When the measured pressure differential is equal to or greater than the threshold pressure differential, controller 298 directs an actuator (not shown) to open bi-directional valve 293, thereby at least partially relieving the pressure differential between regions 71, 72. When valve 293 is opened, fluid in sealed cavity 297 is free to flow across valve 293 into cavity 296 in response to the pressure differential between regions 71, 72. Balance piston 294 moves freely in response to the fluid flow between cavities 296, 297, thereby allowing actuator 281 to transition to an open position. The degree to which bi-directional valve 293 is opened may be varied depending on the comparison between the measured pressure differential aid the threshold pressure differential. For instance, if the measured pressure differential is only slightly greater than the threshold pressure differential, bi-directional valve 293 may be opened to an intermediate position to permit controlled fluid flow between cavities 296, 297. However, if the measured pressure differential is significantly greater than the threshold pressure differential, the actuator may completely open bi-directional valve 293 when the pressure differential threshold is reached, thereby enabling a "soft" or controlled stall. The pressure differential threshold at which valve 280 transitions between the opened and closed position may be adjusted by varying the biasing force of biasing member 282 and by controlling the opening of check valve 293. To minimize the potential for hard stalls, while maximizing the torque output of the hydraulic drive section, the threshold pressure differential may be set slightly below the stall pressure differential. For instance, valve 280 may be configured to open at a threshold pressure differential that is about 80% or 90% of the stall pressure differential.

When the measured pressure differential drops below the threshold pressure differential (due to sufficient differential pressure relief), controller 298 directs the actuator to close bi-directional valve 293. The pressure differential threshold may be pre-loaded into memory associated with the control mechanism 290 prior to installation in the hole, or transmitted from the surface via a downlinking telemetry system such as EM, acoustic signals, mud pressure pulses, wire drill pipe such as the IntelliServe, Inc. downhole network or even over an e-line cable in a wired coil tubing string.

In general, controller 298 may comprise any suitable device for determining a measured pressure differential, comparing the measured pressure differential to a threshold pressure differential, and then directing an actuator in response to the comparison. Example of suitable devices include, without limitation, a microprocessor, a comparator circuit capable, or the like. Further, the actuator that opens and closes valve 293 may comprise any suitable device capable of opening and closing valve 293 including, without limitation, an electronic actuator, a hydraulic actuator, a solenoid, a pneumatic actuator, and the like. Power for the components of valve control mechanism 290 is supplied by power source 295. Power source 295 may comprise any suitable device capable of providing power to mechanism 290 including, without limitation, one or more batteries, a turbine generator, or combinations thereof.

It should be appreciated that in alternative embodiments where the diversion bore (e.g., diversion bore 135) has an outlet between the ends of the rotor (e.g., rotor 130), the threshold pressure differential is preferably adjusted accordingly. For instance, positioning the diversion bore outlet at halfway down the rotor would result in about 50% of the actual pressure differential across the hydraulic drive section to be determined by the controller.

Figure 13:
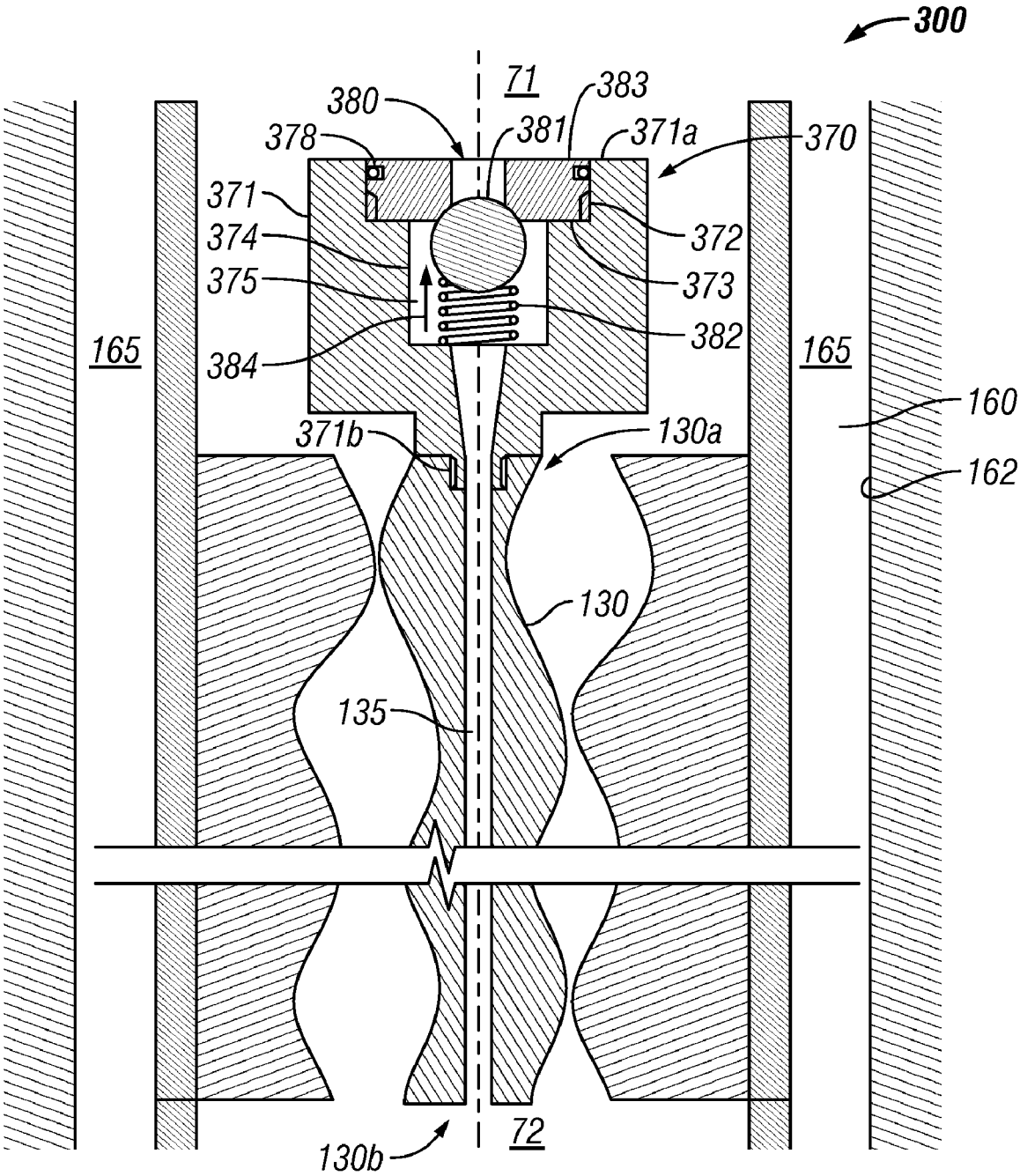
FIG. 13 is partial cross-sectional view of an embodiment of a hydraulic drive section.

Referring now to FIG. 13, another embodiment of a pressure differential regulation mechanism 370 that may be used in the hydraulic drive section of a downhole motor assembly is shown. Similar to pressure differential regulation mechanism 170 previously described, in this embodiment, pressure differential regulation mechanism 370 is coupled to the upper end 130*a* of a rotor 130 and is configured to regulate the pressure differential between legion 71 above the hydraulic drive section and region 72 below the hydraulic drive section via a fluid flow diversion bore 135.

Pressure differential regulation mechanism 370 comprises a generally cylindrical body 371 having an upper or free end 371*a* and a lower or rotor end 371*b* that is axially coupled to upper end 130*a* of rotor 130. Free end 371*a* of body 371 generally distal rotor 130 includes a first counterbore 372 defining an annular shoulder 373, and a second deeper counterbore 374 defining a valve cavity 375 in fluid communication with diversion bore 135. A bypass relief valve 380 is disposed within valve cavity 375 and regulates the flow of drilling fluid between first region 71 and second region 72 through diversion bore 135. In this embodiment, bypass relief valve 380 is a ball valve including a valve actuator 381 and a biasing member 382 that biases valve actuator 381 into engagement with an annular retaining ring 383. More specifically, biasing member 182 is a spring positioned axially between body 371 and valve actuator 381, and is configured to generate a biasing force represented by arrow 384 that biases valve actuator 381 into engagement with retaining ring 383.

Referring still to FIG. 13, annular retaining ring 383 is disposed in first counterbore 372 against shoulder 373 and coupled to body 371, thereby retaining valve actuator 381 and biasing member 382 within valve cavity 375. In addition, in this embodiment, an annular O-ring type seal 378 is positioned between retaining ring 383 and body 371 to restrict and/or prevent the flow of drilling fluid therebetween.

Bypass relief valve 380 has a closed position shown in FIG. 13, in which valve actuator 381 engages retaining ring 383 and restricts and/or prevents fluid communication between region 71 and region 72 via diversion bore 135. Further, bypass relief valve 380 has an opened position in which valve actuator 381 is not fully engaging retaining ring 383, and thus, fluid communication between region 71 and region 72 via diversion bore 135 is permitted. Valve 380 is actuated between the closed position and the opened position by the pressure differential between regions 71, 72. More specifically, valve 380 is biased to the closed position by biasing member 382 which generates biasing force 384. When the pressure differential across regions 71, 72 is sufficient to overcome biasing force 384, valve actuator 381 will move downward and out of engagement with retaining ring 383, thereby opening valve 380. However, when pressure differential between regions 71, 72 is insufficient to overcome biasing force 384, valve actuator 381 will remain biased to the closed position and in positive engagement with retaining ring 383. Thus, in this embodiment, valve 380 is self-regulating. However, in other embodiments, an electronic control mechanism (e.g., control mechanism 290) may be employed to directly control the actuation of valve 380.

Figure 14:
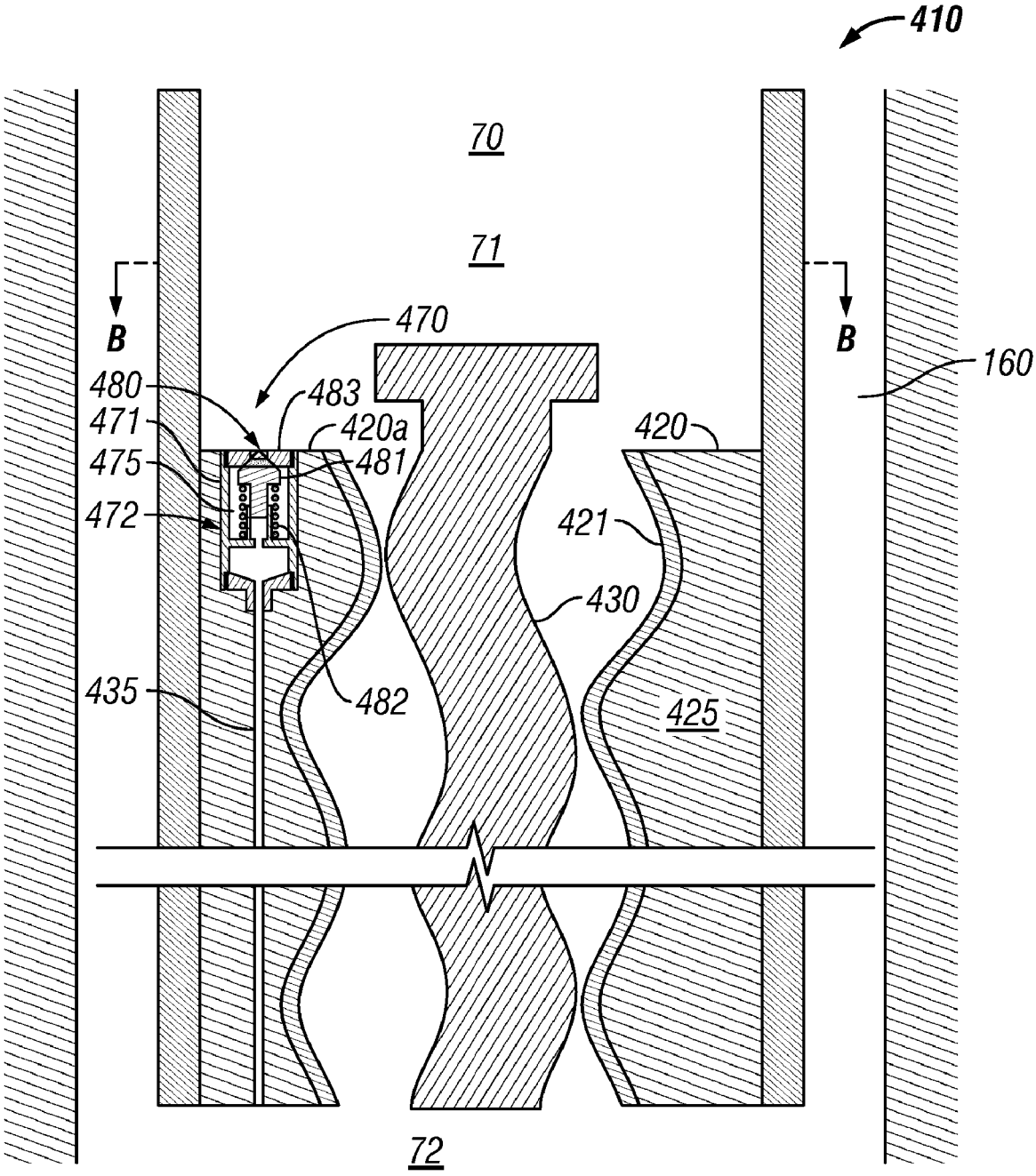
FIG. 14 is an enlarged partial cross-sectional view of an embodiment of a hydraulic drive section of a downhole motor assembly.
Figure 15:
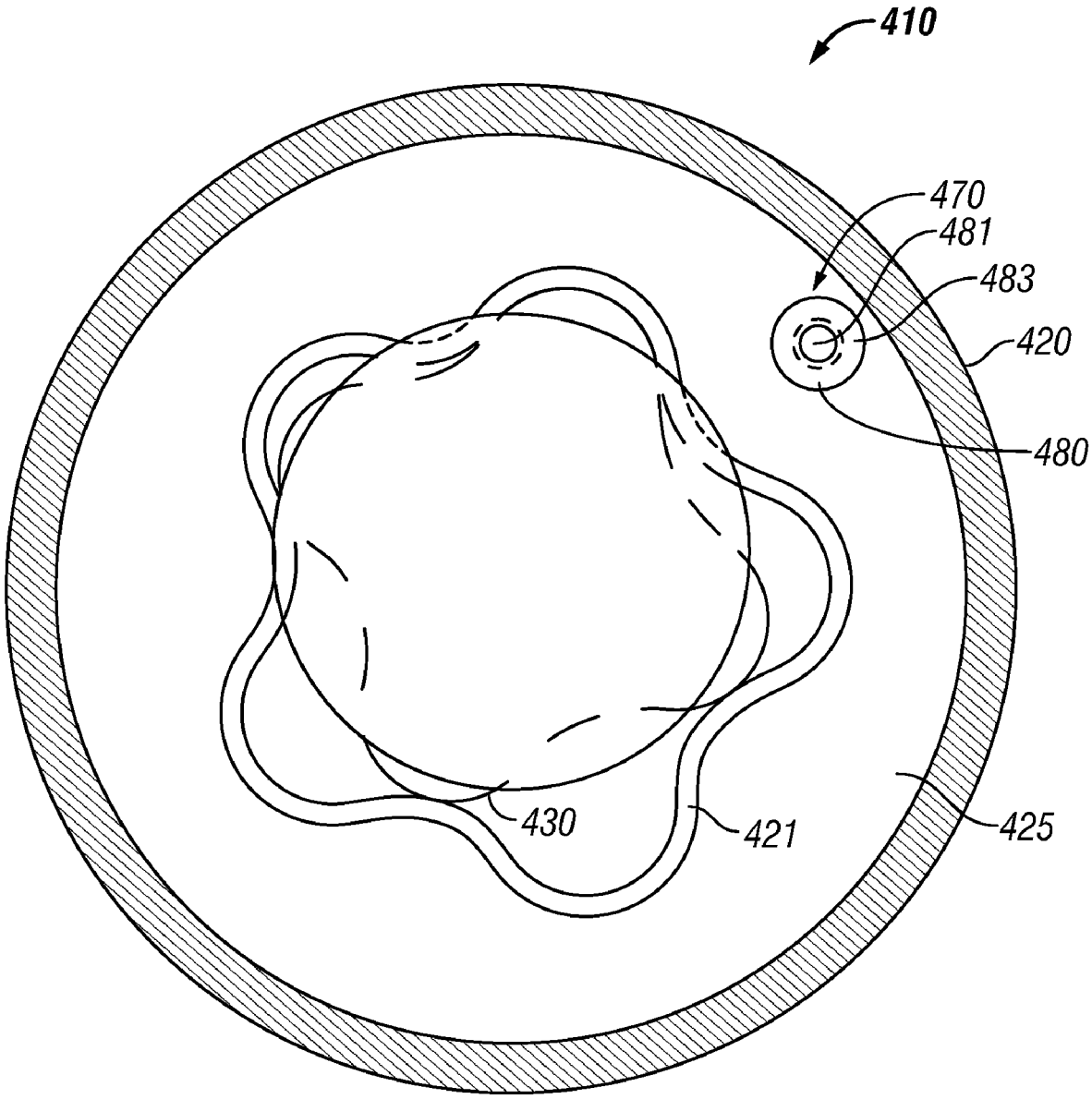
FIG. 15 is a partial cross-sectional view of the hydraulic drive section of FIG. 14 taken along lines B-B.

As shown in FIGS. 6-8, pressure differential regulation mechanism 170 is coupled to the upper end 130*a* of the rotor 130, and bypass relief valve 180 is in fluid communication with the diversion bore 135 extending through the rotor 130. However, the pressure differential regulation mechanism, including the bypass relief valve, and the diversion bore may be positioned in a variety of other suitable locations, yet still offer the potential for the same benefits described above. For instance, referring now to FIGS. 14 and 15, another embodiment of a hydraulic drive section 400 that may be employed in a progressive displacement motor (PDM) or downhole mud motor is shown. Hydraulic drive section 410 is substantially the same as hydraulic drive section 110 previously described. Namely, hydraulic drive section 410 includes a helical rotor 430 disposed within a mating stator 420 including an inner liner or insert 421 statically disposed within an outer housing 425. However, in this embodiment, stator 420 is a constant wall thickness stator; where the inner liner 421 has a substantially uniform radial thickness. Thus, although the outer radial surface of housing 425 is cylindrical, the interfacing surfaces of housing 425 and liner 421 are helical. For the reasons previously described, liner 221 preferably comprises an elastomeric material while rotor 230 and housing 225 preferably comprises stainless steel.

Unlike hydraulic drive section 110 previously described, in thus embodiment, a pressure differential regulation mechanism is not provided in the rotor. Rather, in this embodiment, a pressure differential regulation mechanism 470 is disposed in stator 420 and more particularly, disposed within stator housing 425. Regulation mechanism 470 comprises a valve body 471 including a valve cavity 475, a bypass relief valve 480 disposed within valve cavity 475, and a fluid flow diversion bore 435 extending between valve 480 and region 72 through stator housing 425. Valve body 471 is disposed within a counterbore 472 provided in the upper end of stator housing 425, and is in fluid communication with diversion bore 435. Thus, bypass relief valve 480 is regulates the flow of drilling fluid between first region 71 and second region 72 through diversion bore 435. In this embodiment, bypass relief valve 480 is substantially the same as bypass relief valve 180 previously described. Namely, bypass relief valve 480 comprises a valve actuator 481 and a biasing member 482 that biases valve actuator 481 into engagement with an annular retaining ring 483. It should be appreciated that a constant wall thickness stator (e.g., stator 420) may be preferred in embodiments including a bypass relief valve (e.g., bypass relief valve 480) and bypass flow passage (e.g., bypass flow passage 435) positioned in the stator. In particular, as compared to an elastomeric liner, a rigid outer housing including stainless steel provides a more robust material for disposing and positioning a bypass relief valve and bypass flow passage. In a conventional stator having a cylindrical housing, space limitations may necessitate the positioning of the bypass relief valve and bypass flow passage through the elastomeric liner. Whereas in a constant wall stator, typically having a radially thicker housing, sufficient radial space in the housing is available for the positioning of the bypass relief valve and the bypass flow passage.

Bypass relief valve 480 functions substantially the same as bypass relief valve 480 previously described with reference to FIGS. 6-8. Namely, bypass relief valve 480 has a closed position shown in FIG. 14, in which valve actuator 481 engages retaining ring 483 and restricts and/or prevents fluid communication between region 71 and region 72 via diversion bore 435. When bypass relief valve 480 is in the closed position, drilling fluid pumped from the surface down flow passage 70 flows through the series of cavities that form between rotor 430 and stator 420, but is restricted from flowing into diversion bore 435. In addition, bypass relief valve 480 has an opened position in which valve actuator 481 is not fully engaging retaining ring 483, and thus, fluid communication between region 71 and region 72 via diversion bore 435 is permitted. When bypass relief valve 280 is in the opened position drilling fluid pumped from the surface down flow passage 70 is permitted to flow through the series of cavities between rotor 430 and stator 420, and is also free to flow through diversion bore 435, Any drilling fluid that passes from region 71 to region 72 via diversion bore 435 effectively bypasses hydraulic drive section 410.

In this embodiment, valve 480 is actuated between the closed position and the opened position by the pressure differential or drop across hydraulic drive section 410 between regions 71, 72. In this sense valve 480 maybe described as being "self-regulated". However, in other embodiments, valve 480 may be actuated by an electronic control mechanism (e.g., electronic control mechanism 290). Further, although only one pressure differential regulation mechanism 470 is shown in this embodiment, in other embodiments, more than one pressure differential regulation mechanism may be provided.

As shown in the embodiments previously described, a fluid flow diversion bore (e.g., diversion bore 135) provides a flow path between the region immediately above the hydraulic drive section (e.g., region 71) and the region immediately below the hydraulic drive section (e.g., region 72). However, in other embodiments, the fluid flow diversion bore regulated by the bypass relief valve may provide a flow path between the region immediately above the hydraulic drive section and the annulus between the hydraulic drive section and the borehole sidewall. For instance, referring now to FIG. 16, another embodiment of a hydraulic drive section 510 that may be employed in a progressive displacement motor (PDM) or downhole mud motor is shown. Hydraulic drive section 510 is substantially the same as hydraulic drive section 410 previously described, except that the fluid flow diversion bore is in fluid communication with the annulus between the drill string and the borehole sidewalls. Namely, hydraulic drive section 510 includes a helical rotor 530 disposed within a mating constant wall thickness stator 520 including an inner liner or insert 521 statically disposed within an outer housing 525. A pressure differential regulation mechanism 570 including a bypass relief valve 580 and a fluid flow diversion bore 535 is disposed in stator housing 525. Bypass relief valve 580 is substantially the same as bypass relief valve 180 previously described. Valve 580 regulates the flow of drilling fluid from region 71 into diversion bore 535. However, in this embodiment, diversion bore 535 is not in fluid communication with region 72, but rather, passes radially out of stator 520 to the annulus 165 between the drill string and the sidewall 162 of borehole 160. Thus, valve 580 regulates the flow of drilling fluid between region 71 and annulus 165.

Figure 16:
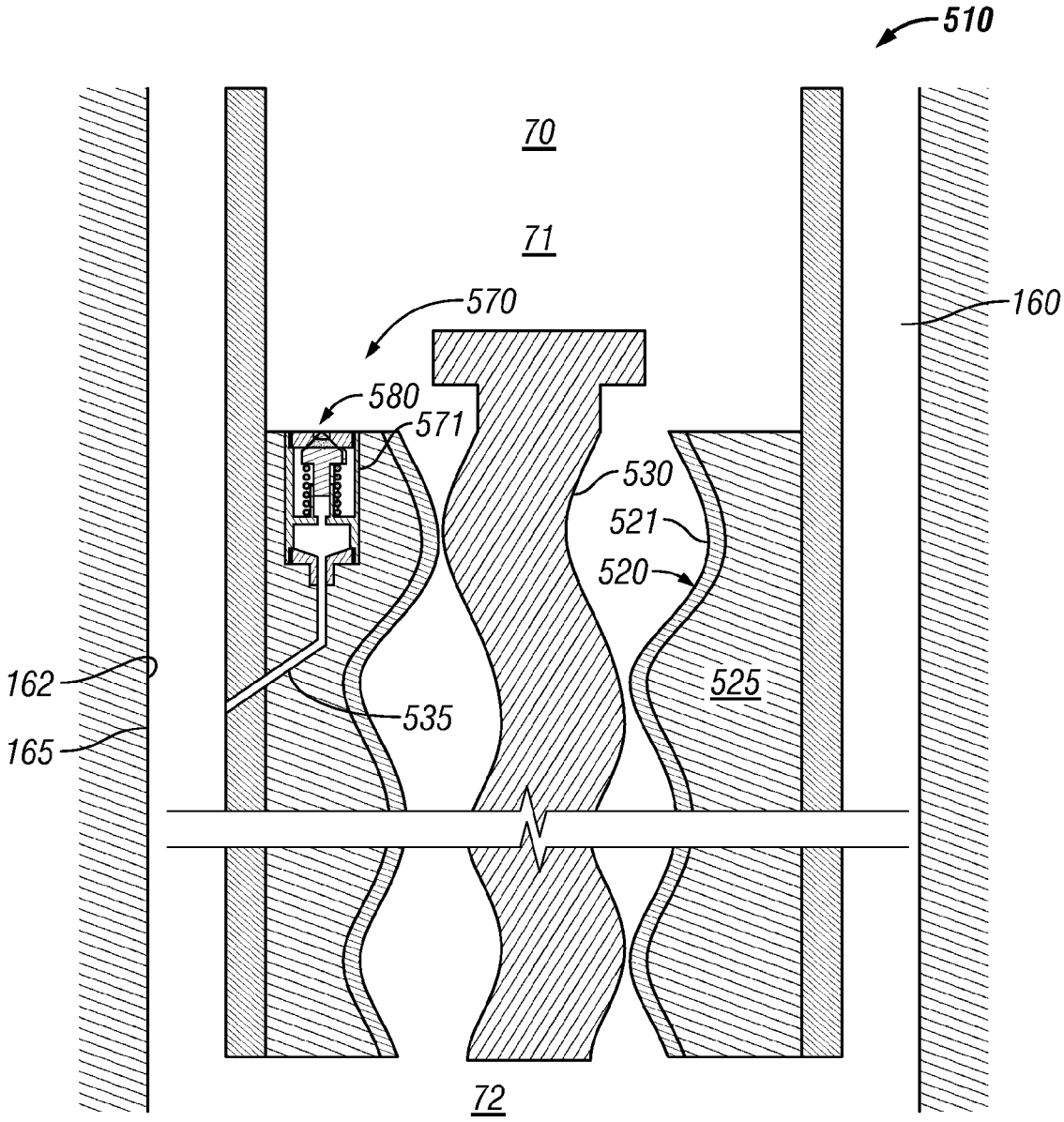
FIG. 16 is an enlarged partial cross-sectional view of an embodiment of a hydraulic drive section of a downhole motor assembly.

Referring still to FIG. 16, bypass relief valve 580 functions substantially the same as bypass relief valve 180 previously described. Namely, bypass relief valve 580 has a closed position in which the flow of drilling fluid in region 71 to annulus 165 via diversion bore 535 is restricted. When bypass relief valve 580 is in the closed position, drilling fluid pumped from the surface down flow passage 70 flows between rotor 530 and stator 520 from region 71 to region 72, but is restricted from flowing into diversion bore 535. In addition, bypass relief valve 580 has an opened position in which fluid communication between region 71 and annulus 165 via diversion bore 535 is permitted. When bypass relief valve 580 is in the opened position drilling fluid pumped from the surface down flow passage 70 is permitted to flow between rotor 530 and stator 520 from region 71 to region 72, and is also free to flow through diversion bore 535 from region 71 to annulus 165. Any drilling fluid that passes from region 71 to annulus 165 via diversion bore 535 effectively bypasses hydraulic drive section 510.

In this embodiment, valve 580 is actuated between the closed position and the opened position by the pressure differential or drop between region 71 and annulus 165. Thus, the biasing mechanism that biases valve 580 to the closed position may be tailored to open at a predetermined pressure differential between region 71 and annulus 165. Although embodiments described herein include a bypass relief valve generally disposed at the upper end of the hydraulic drive section, the bypass relief valve could alternatively be positioned between the upper and lower ends of the hydraulic drive section or at the lower end of the hydraulic drive section to regulate the differential pressure across the hydraulic drive section.

Further, although the embodiments disclose downhole mud motors including one or more bypass relief valve(s) to regulate the pressure differential across the motor, such bypass relief valves may also be employed in progressive cavity pumps. For example, by rotating the rotor in reverse, the progressive cavity device may be used to pump fluid to the surface. By including a bypass relief valve in such a progressive cavity pump, if the pressure differential across the pump is excessively high, the bypass relief valve will open, thereby limiting the torque applied to the rotor. Such an approach offers the potential to tune the pump to run at an optimal RPM and efficiency by identifying the point at which additional rotational energy applied to the rotor does not result in increased pumped fluid volume and damaging operating levels.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A downhole motor assembly for driving a drill bit to form a borehole, the downhole motor assembly including:

a hydraulic drive section operatively connected to the drill bit and a drill string, the hydraulic drive section including a stator and a rotor located inside the stator, the stator and rotor forming a flow path between the stator and the rotor such that fluid flowing through the flow path in response to a pressure differential across the hydraulic drive section creates an operative force to rotate the drill bit; and a regulation mechanism including a valve and a fluid flow diversion bore for diverting at least some fluid from the flow path when the pressure differential across the hydraulic drive section is greater than or equal to a transition pressure differential, wherein the fluid flow diversion bore extends radially outward through the stator to an annulus between the drill string and a sidewall of the borehole.

2. The downhole motor assembly of claim 1, where the valve includes a biased closed, self-regulating valve that operates based on the pressure differential across the hydraulic drive section to maximize the operative force on the drill bit for a given resistive torque on the drill bit.

3. The downhole motor assembly of claim 1, where the fluid flow diversion bore includes a flow path through a portion of the length of the stator.

4. The downhole motor assembly of claim 1, where the pressure differential across the hydraulic drive section remains less than a stall pressure differential for the hydraulic drive section.

5. The downhole motor assembly of claim 1, where the transition pressure differential is less than a stall pressure differential for the hydraulic drive section.

6. The system of claim 1, where the transition pressure differential is less than a stall pressure differential for the hydraulic drive section.

7. A method of drilling a subterranean wellbore using a drill bit including:

applying an operative force to the drill bit using a downhole motor assembly, the downhole motor assembly coupled to a drill string and including:

a hydraulic drive section including a stator and a rotor located inside the stator, the stator and rotor forming a flow path between the stator and the rotor; and a regulation mechanism including a valve and a fluid flow diversion bore extending radially outward through the stator to an annulus between the drill-string and a sidewall of the wellbore;

where applying the operative force includes flowing fluid through the flow path to create the operative force;

decreasing the amount operative force on the drill bit when the pressure differential across the hydraulic drive section is greater than or equal to a transition pressure differential by operating the regulation mechanism to divert at least some fluid from the flow path and into the fluid flow diversion bore; and maintaining at least some operative force on the drill bit while diverting fluid flow.

8. The method of claim 7, where:

the valve includes a biased closed, self-regulating valve;

decreasing the operative force on the drill bit includes diverting at least some fluid flow by operating the valve based on the pressure differential across the hydraulic drive section; and operating the valve includes maximizing the operative force on the drill bit for a given resistive force.

9. The method of claim 7, where decreasing the operative force on the drill bit includes diverting at least some fluid flow by operating the valve using an actuator to divert fluid into the diversion bore.

10. The method of claim 7, where the fluid flow diversion bore includes a flow path through a portion of the length of the stator.

11. The method of claim 7, further including maintaining the pressure differential across the hydraulic drive section less than a stall pressure differential for the hydraulic drive section.

12. The method of claim 7, where maintaining at least some operative force on the drill bit while diverting fluid flow includes at least one of opening the valve, lowering the RPM of the rotor, and lowering the amount of available torque to counteract the resistive torque.

13. The method of claim 12, where lowering the amount of available torque on the drill bit comprises flowing fluid under a lower pressure through the flow path.

14. A subterranean wellbore drilling system including:

a drill bit connected with a drill string; and a downhole motor assembly within the drill string for driving the drill bit, the downhole motor assembly including:

a hydraulic drive section operatively connected to the drill bit, the hydraulic drive section including a stator and a rotor located inside the stator, the stator and rotor forming a flow path between the stator and the rotor such that fluid flowing through the flow path in response to a pressure differential across the hydraulic drive section creates an operative force to operate the drill bit; and a regulation mechanism including a valve and a fluid flow diversion bore for diverting at least some fluid from the flow path when the pressure differential across the hydraulic drive section is greater than or equal to a transition pressure differential, wherein the fluid flow diversion bore extends radially outward through the stator to an annulus between the drill string and a sidewall of the wellbore.

15. The system of claim 14, where the valve includes a biased closed, self-regulating valve that operates based on the pressure differential across the hydraulic drive section to maximize the operative force on the drill bit for a given resistive torque.

16. The system of claim 14, where the fluid flow diversion bore includes a flow path through a portion of the length of the stator.

17. The system of claim 14, where the pressure differential across the hydraulic drive section remains less than a stall pressure differential for the hydraulic drive section.

* * * * *